United States Patent [19]

Kato

[11] 4,145,995

[45] Mar. 27, 1979

[54] METHOD OF OPERATING A POWER PLANT AND APPARATUS THEREFOR

[75] Inventor: Shunji Kato, Hitachi, Japan

[73] Assignee: Hitachi, Ltd., Japan

[21] Appl. No.: 813,228

[22] Filed: Jul. 6, 1977

[30] Foreign Application Priority Data

Jul. 14, 1976 [JP] Japan ..... 51/82951

[51] Int. Cl.[2] ..... F22B 33/00

[52] U.S. Cl. ..... 122/1 R; 122/7 R; 122/448 B

[58] Field of Search ..... 122/1 R, 7 R, 448 B, 122/406 R; 237/61

[56] References Cited

U.S. PATENT DOCUMENTS

| | | | |
|---|---|---|---|
| 2,480,883 | 9/1949 | Schramm | 237/61 |
| 3,118,429 | 1/1964 | Hochmuth | 122/7 R |
| 3,169,373 | 2/1965 | Hanzalek | 122/1 R |
| 3,314,231 | 4/1967 | Hochmuth | 122/7 R |
| 3,443,550 | 5/1969 | May et al. | 122/7 R |
| 3,884,193 | 5/1975 | Bryers | 122/7 R |
| 3,974,644 | 8/1976 | Martz et al. | 122/7 B |
| 4,037,779 | 7/1977 | Roy et al. | 237/61 |

*Primary Examiner*—Henry C. Yuen
*Attorney, Agent, or Firm*—Craig & Antonelli

[57] ABSTRACT

In the control of the operation of a power plant including a gas turbine power generating unit, a main boiler whose heat source is exhaust gas of the gas turbine and which supplies steam to a heat load, a back-up boiler which has an independent fuel system and which is operated to supply steam to the heat load when the quantity of supply of steam of the main boiler to the load is insufficient, and a heat exchanger which is disposed in a boiler feeding system common to the main boiler and the back-up boiler and which receives excess steam or condensed water as discharged from the heat load and heats feed water, a method of operating a power plant and apparatus therefor comprising a circulating pipe for connecting a steam generating portion of the back-up boiler and the heat exchanger and for causing boiler feed water to flow from the back-up boiler back to the heat exchanger even during shutdown of the back-up boiler, and valve means disposed in the circulating pipe and adapted to be shut when a condition of the generating steam of the main boiler for the heat load is insufficient and when the back-up boiler is operated, whereby the temperature of the steam generating portion of the back-up boiler is held at above a predetermined temperature even during the shutdown of the back-up boiler.

4 Claims, 2 Drawing Figures

METHOD OF OPERATING A POWER PLANT AND APPARATUS THEREFOR

BACKGROUND OF THE INVENTION

This invention relates to a method of controlling the operation of a power plant, and apparatus for performing the method. More particularly, it relates to a method of operating a power plant including a gas turbine power generating unit, a gas turbine waste heat recovery boiler whose heat source is the exhaust gas of the gas turbine, and a back-up boiler which backs up the waste heat recovery boiler, and also to apparatus for performing the method.

In a power plant including a gas turbine power generating unit and a main boiler whose heat source is the waste heat of the gas turbine, when the fluctuation of a heat load (for example, steam turbine) driven by steam produced by the main boiler is great, the quantity of steam becomes insufficient with only the steam produced by the main boiler. In order to compensate for the insufficient quantity of vaporization of the main boiler, a back-up boiler is usually provided. The back-up boiler is operated only when the quantity of vaporization of the main boiler is insufficient, whereas it is stopped when the heat load can be satisfactorily driven with only the quantity of producing steam of the main boiler.

A problem in the power plant of the type described above is that when the heat load of the power plant has increased suddenly, the back-up boiler normally held in the shutdown state cannot be rapidly started, so the supply of energy to the heat load becomes insufficient temporarily. As one expedient for solving the problem, it is thought to normally operate the back-up boiler. This measure, however, is unfavorable in being very uneconomical and in lowering the thermal efficiency of the power plant.

SUMMARY OF THE INVENTION

An object of this invention is to provide a method of operating a power plant having a waste heat recovery boiler whose heat source is the exhaust gas of a gas turbine and which supplies steam to a heat load such as steam turbine, and a back-up boiler which backs up the waste heat recovery boiler, the method being capable of rapidly starting the back-up boiler.

Another object of this invention is to provide apparatus for operating a power plant having a waste heat recovery boiler whose heat source is the exhaust gas of a gas turbine and which supplies steam to a heat load such as steam turbine, and a back-up boiler which backs up the waste heat recovery boiler, the apparatus being capable of rapidly starting the back-up boiler.

This invention consists in a power plant having a waste heat recovery boiler whose heat source is exhaust gas from a high-temperature gas producing unit and which supplies steam to a heat load, a back-up boiler which has a fuel system and which backs up the waste heat recovery boiler, and a feeding system which conducts condensed water, discharged from the heat load, to the waste heat recovery boiler and the back-up boiler, with the feed water being returned from a drum of the back-up boiler to the feeding system even during shutdown of the back-up boiler so as to normally circulate the feed water through the back-up drum, whereby the temperature of the steam generating portion of the back-up boiler is raised up to a predetermined temperature even during shutdown of the back-up boiler, to make rapid starting of the back-up boiler possible.

DESCRIPTION OF THE PREFERRED EMBODIMENT

Hereunder, an embodiment of this invention will be described with reference to the accompanying drawing.

Figure 1:
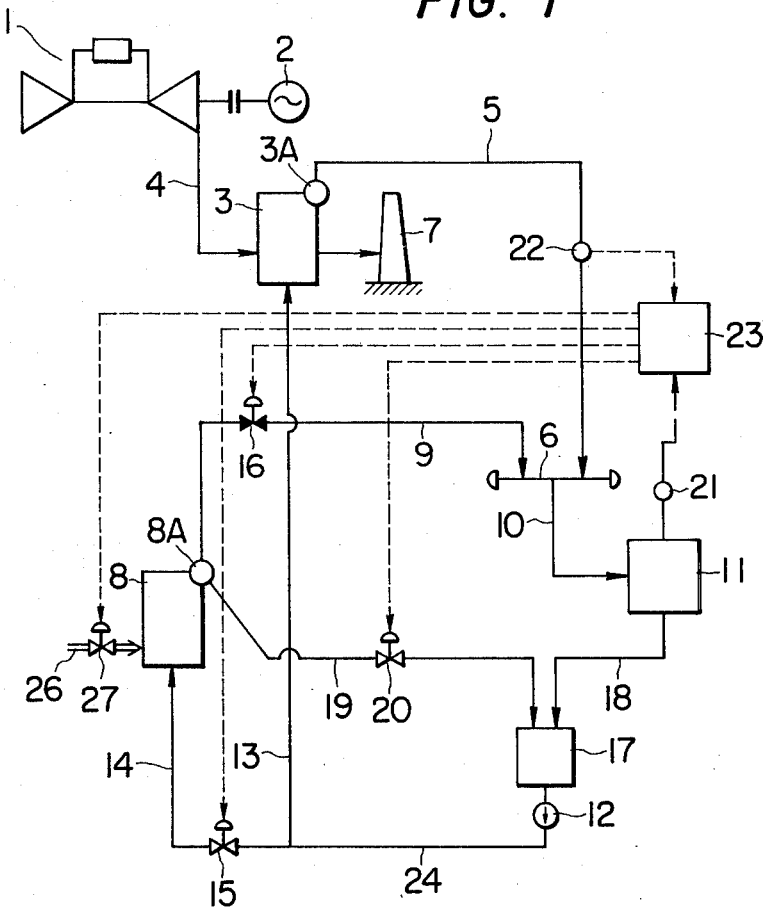
FIG. 1 shows an embodiment of this invention, and is a flow diagram of a power plant which includes a waste heat recovery boiler for supplying steam to a heat load and a back-up boiler for backing up the waste heat recovery boiler.

FIG. 1 is a flow diagram of a power plant which includes the apparatus of this invention. In the figure, numeral 1 designates a gas turbine, by which a generator 2 is directly driven. Numeral 3 is a main boiler. It is a waste heat recovery boiler whose heat source is exhaust gas supplied from the gas turbine 1 through duct 4. Steam produced in the main boiler 3 is supplied to a steam header 6 through a steam pipe 5. The gas whose temperature has lowered due to heat exchange for the production of the steam in the main boiler 3 is discharged into the atmospheric air from a stack 7. Connected also to the steam header 6 is a steam delivery pipe 9 of a back-up boiler 8 which is an ordinary boiler. Thus, steam is introduced into the steam header 6 from either or both of the boilers 3 and 8. Further, a heat load, such as steam turbine and heat exchanger, 11 is connected to the steam header 6 through a main steam pipe 10.

The main boiler 3 and the back-up boiler 8 are boilers of the same type, and only the main boiler 3 can utilize the exhaust gas as the heat source. While they may be drum type boilers respectively having drums 3A and 8A as shown by way of example in the figure, they may well be once-through boilers. The boilers 3 and 8 are supplied with water from a common boiler feeding system, and they are connected through respective feed pipes 13 and 14 to a feed pipe 24 equipped with a feed water pump 12. Since, however, the back-up boiler 8 is usually stopped as previously stated, the feed pipe 14 and the steam delivery pipe 9 of the back-up boiler 8 are respectively provided with shut-off valves 15 and 16.

A heat exchanger (or a feed water tank) 17 is disposed on the suction side of the feed water pump 12, and a condenser pipe 18 is arranged between the heat exchanger 17 and the heat load 11, so that the remainder of thermal energy used in the heat load 11 is recovered in the boiler feeding system .

A circulating pipe 19 for returning the boiler feed water from the back-up boiler 8 to the boiler feeding system is disposed between the steam generating portion of the back-up boiler 8, i.e., the drum 8A and the heat exchanger 17 of the boiler feeding system. The circulating pipe 19 is provided with a valve 20. The valve 20 is closed only during the running of the back-up boiler 8, and it is kept open during the shutdown of the back-up boiler 8.

The heat load 11 is provided with a load state detector 21 for detecting the fluctuation of the load, while the steam pipe 5 of the main boiler 3 is provided with a steam condition detector 22 for detecting the steam condition of the main boiler. The outputs of both the detectors 21 and 22 become inputs to a controller 23. The controller 23 controls to open and shut the valves 15, 16 and 20 in response to the outputs of the detectors 21 and 22.

Now, the operation of the various parts in the power plant as described above will be explained.

When the steam energy generated from the main boiler 3 fulfills the necessary energy of the heat load 11, the valves 15 and 20 are open and the valve 16 is closed. Accordingly, the heat load 11 is supplied with only the steam produced by the main boiler 3. Since the valves 15 and 20 are open, the feed water is supplied from the feed water pump 12 not only to the main boiler 3 but also to the back-up boiler 8. The feed water is heated to a temperature of about 120° C. by condensed water which flows into the heat exchanger 17 disposed in the boiler feeding system. The water pipe and the drum 8A of the back-up boiler 8 are therefore heated in spite of the fact that the back-up boiler is shut down. Since the valve 20 is open, the feed water sent into the drum 8A flows back to the heat exchanger 17 through the circulating pipe 19. Here the water is again heated by the condensed water from the load 11, whereupon it is fed into the back-up boiler 8.

However, when the heat load 11 has risen greatly and the amount of production of steam of the main boiler 3 becomes short of the necessary amount of steam of the heat load 11, or where the main boiler 3 has stopped by the trip of the gas turbine 1 or the steam condition of the main boiler 3 has noticeably lowered by any other cause, the balance between the output of the load state detector 21 and that of the steam condition detector 22 is lost. In response thereto, the controller 23 operates to close the valve 20 and to simultaneously open the valve 16. Further, it opens a control valve 27 disposed in a fuel system 26 for supplying fuel to the back-up boiler 8, so as to start the back-up boiler 8. In this case, the steam generating portion of the back-up boiler 8 has been already heated to a certain temperature as described previously. Therefore, the rise of the back-up boiler 8 is quick, and the back-up boiler 8 can be brought into the rated running state in a comparatively short time after the time when the condition of the steam being supplied from the main boiler 3 to the heat load 11 has become inferior.

Figure 2:
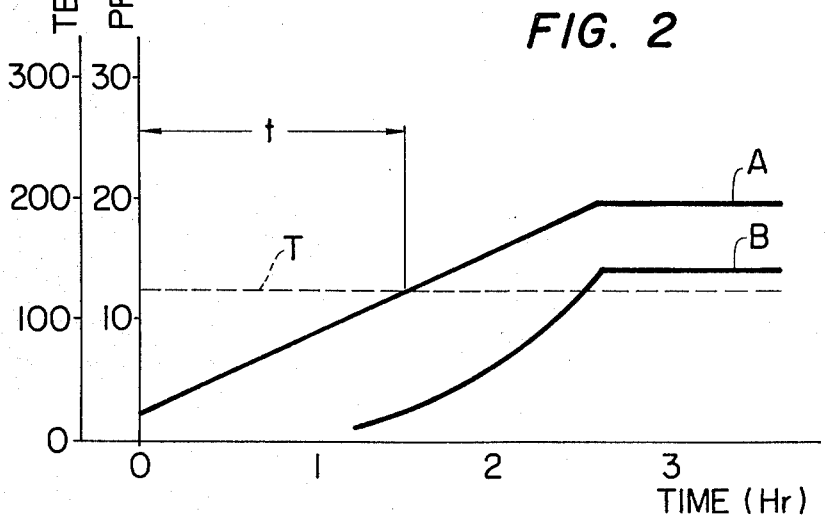
FIG. 2 is a graph showing the relations between the starting time of a back-up boiler according to this invention and the steam temperature and pressure in a drum.

FIG. 2 is a graph which illustrates an example of the effect according to this invention. The axis of abscissas represents the elapsed time, while the axes of ordinates represent the temperature and pressure in the drum 8A of the back-up boiler 8.

A line A in FIG. 2 indicates the variation of the saturation temperature in the drum after starting the back-up boiler which has not been heated at all till then. A curve B indicates the variation of the pressure in the drum in the same case.

As understood from FIG. 2, when the steam generating portion of the boiler has not been heated at all during the shutdown, it takes more than 2 hours and 30 minutes after the starting before the temperature in the drum reaches 200° C. which is the serviceable temperature. In contrast, when as in this invention the drum and the water pipe are kept heated to a feed water temperature T as shown by a dotted line in FIG. 2 even during shutdown, the period of time before the drum reaches 200° C. is shortened to the extent of a period of time indicated by t in FIG. 2 (1 hour and 30 minutes in the illustrated example), and the rise of the back-up boiler can be increased to as much as over 1 hour. Moreover, in accordance with this invention, in achieving such effect, the efficiency of the power plant is not lowered considerably, and the back-up boiler can be started very economically.

I claim:

1. In a method of controlling the operation of a power plant including a gas turbine power generating unit, a main boiler whose heat source is exhaust gas of the gas turbine and which supplies steam to a heat load, a back-up boiler which has an independent fuel system and which supplies steam to the heat load only when the condition of the steam supplied by the main boiler has become insufficient, and a heat exchanger which is disposed in a feeding system common to the main boiler and the back-up boiler and which receives excess steam or condensed water as discharged from the heat load and heats feed water, a method of operating said power plant wherein the improvement comprises the steps of feeding water from said heat exchanger to said back-up boiler even during shutdown of said back-up boiler, and returning said feed water from a drum of said back-up boiler to said heat exchanger, whereby the temperature of the steam generating portion of said back-up boiler is held at a predetermined temperature even during the shutdown thereof.

2. The method of operating a power plant as defined in claim 1, wherein said feed water returning from said drum of said back-up boiler to said heat exchanger is subsequently stopped when said back-up boiler is started, and said fuel system is simultaneously actuated to start said back-up boiler.

3. In an apparatus for controlling the operation of a power plant including a gas turbine power generating unit, a main boiler whose heat source is exhaust gas of the gas turbine and which supplies steam to a heat load, a back-up boiler which has an independent fuel system and which supplies steam to the heat load only when the condition of the steam supplied from the main boiler has become insufficient, and a heat exchanger which is disposed in a feeding system common to the main boiler and the back-up boiler and which receives excess steam or condensed water as discharged from the heat load and heats feed water, an apparatus for operating said power plant wherein the improvement comprises a circulating pipe means which connects a steam generating portion of said back-up boiler to said heat exchanger for returning boiler feed water from said back-up boiler to said heat exchanger, and valve means which is disposed in said circulating pipe means for selectively opening and closing in response to a condition of the generating steam of said main boiler for said heat load.

4. The apparatus for operating a power plant as defined in claim 3, characterized by comprising a load state detector which detects a state of said heat load, a steam state detector which detects a steam state of said main boiler, and a controller which compares a load signal of said load state detector with a steam signal of said steam state detector and which, when the former exceeds the latter, closes said valve means and simultaneously actuates said fuel system of said back-up boiler to start said back-up boiler.

* * * * *